US006019477A

United States Patent [19]

Wegrzyn et al.

[11] Patent Number: 6,019,477

[45] Date of Patent: Feb. 1, 2000

[54] EMERGENCY LIGHTING DEVICE

[75] Inventors: Joseph Wegrzyn, Stratford; Jeff Holmes, Beacon Falls, both of Conn.; Milt Erickson, Merrillan, Wis.

[73] Assignee: Dual-Lite Inc., Cheshire, Conn.

[21] Appl. No.: 08/888,155

[22] Filed: Jul. 3, 1997

[51] Int. Cl.[7] ..... F21V 21/14

[52] U.S. Cl. ..... 362/20; 362/287; 362/322; 362/427; 362/238; 362/249

[58] Field of Search ..... 362/20, 285, 287, 362/427, 249, 250, 238, 430, 418, 364, 365, 239, 322, 240

[56] References Cited

U.S. PATENT DOCUMENTS

| | | | |
|---|---|---|---|
| D. 264,253 | 5/1982 | Goldschmidt et al. . | |
| D. 264,254 | 5/1982 | Heritage . | |
| D. 320,863 | 10/1991 | Macaluso . | |
| D. 354,147 | 1/1995 | Veda . | |
| D. 390,981 | 2/1998 | Kaczorowski . | |
| 3,702,928 | 11/1972 | Alger | 362/804 |
| 3,772,527 | 11/1973 | Darling et al. . | |
| 4,499,528 | 2/1985 | Hawlitzki . | |
| 5,050,047 | 9/1991 | Viner et al. | 362/250 |
| 5,055,988 | 10/1991 | Cartwright | 362/294 |
| 5,797,673 | 8/1998 | Logan et al. | 362/250 |

OTHER PUBLICATIONS

Quantum Combo and Quick–Mount—Lithonia Lighting Jan. 1995.
Quantum—Lithonia Lighting pp. 194–195, 200–201.
Atlite Contours (PC 1–10)—Atlite Lighting pp. 2–7.
Cavalier—Lightalarms Elec. pp. D1A–D1B Jan. 1990.
Celebrity—Chloride Systems Spec. Sheet #C1000.
Gem Light—Chloride Systems Spec. Sheet #C1003.
6MF/6NMF Series—Chloride Systems Spec. Sheet #C1043.
Infinity Series II—Chloride Systems Spec. Sheet #C1064.
Escort Series, Provider Series, ME Series, JS Series and LP, LS and LC Series—Emergi–Lite pp. 9–16.
EMAX–P.8; ELB Series–P.10; Designer Series–P.5; Emergency Light/Exit Combination–P.30; EDS–P. EL1—Prescolite Emergency Sys. Oct. 1989.
CCX Contractor's Choice Exits and Emergency Lighting—Sure–Lites.
Pathfinder Series Exit Sign—Hubbell Lighting Nov. 1992.
PE Series Emergency Lighting—Hubbell Lighting Sep. 1991.
Series DM,DS—Lightalarms—pp. D3–D4 Jul. 1988.
KB–1—Lightalarms—Nov. 1990.
Watchguard EMS—Sure–Lites.
Windsor—Big Beam Emergency System, Inc.
Emergency Lighting Products—Dual–Lite Nov. 1996.
Two (2) photographs of Prescolite Designer Series Emergency Light.
Two (2) photographs of Lithonia Lighting LH QM Series Emergency Light.

(List continued on next page.)

*Primary Examiner*—Thomas M. Sember
*Attorney, Agent, or Firm*—Ware, Fressola, Van der Sluys & Adolphson LLP

[57] ABSTRACT

An emergency lighting unit comprises a housing which contains the lighting unit circuitry. The housing includes a wall which defines at least one substantially circular opening therein. Extending partially through this opening is a substantially spherical lighting head containing a light source, such as a halogen lamp. The lighting head is rotatable by hand to any desired rotation to vary the field of illumination.

38 Claims, 8 Drawing Sheets

OTHER PUBLICATIONS

Two (2) photographs of Chloride Systems Infinity Series Emergency Light.

Two (2) photographs of Chloride Systems Celebrity Series Emergency Light.

Two (2) photographs of Atlite Lighting Equipment, Inc. PC Series Emergency Light.

Two (2) photographs of Emergi–Lite Escort Series Emergency Light.

Two (2) photographs of Emergi–Lite PRO Series Emergency Light.

Three (3) photographs of Chloride Systems GM Series Emergency Light.

Two (2) photographs of Hubbell Lighting Inc. PE Series Emergency Light.

Two (2) photographs of Emergi–Lite Escort Series Emergency Light.

Two (2) photographs of Lightalarms Electronic Corp. Cavalier II Emergency Light.

Two (2) photographs of JUNO Lighting, Inc. ECR Series Emergency Light.

Six (6) photographs of Lithonia Lighting ELM Series Emergency Light.

Two (2) photographs of Sure–Lites/Cooper Lighting CCX Series Emergency Light.

EMERGENCY LIGHTING DEVICE

BACKGROUND OF THE INVENTION

1. Technical Field.

The present invention relates generally to electrical lighting sources. More particularly, it relates to emergency electrical lighting sources.

2. Description of the Prior Art.

Under current local fire and building codes, buildings to which the public has access are required to have emergency lighting devices. These devices must provide specific amounts of illumination and have emergency backup power sources to provide emergency illumination to lights for a specified period of time during periods when utility power to the building is discontinued, thereby facilitating egress of persons from the building.

Traditionally, two incandescent lamps driven by a self-contained emergency battery power supply are used for illumination during power failure situations. A switching or transfer device will automatically operate the emergency illumination system when a power failure is detected.

While these traditional lighting arrangements perform adequately, they do have a few drawbacks. A major drawback is that the incandescent bulbs use large amounts of electrical power, thus requiring a relatively large emergency battery power supply for use during emergency lighting situations. Furthermore, while the incandescent bulbs provide adequate illumination, such bulbs do not have a long life in service and require frequent replacement.

It is an object of the present invention to provide a novel emergency lighting device using commercially available halogen lamps.

It is also an object to provide such a lighting device which allows the halogen lamps to be powered by an emergency battery power supply and associated charging and transfer circuitry during emergency power situations.

Still another object is to provide such a lighting device in which the halogen lamps are arranged to provide the amount of illumination required by building codes.

A further object is to provide such a lighting device which may be readily and economically fabricated and will enjoy a long life in operation.

SUMMARY OF THE INVENTION

The invention comprises an emergency lighting unit in the form of a housing containing the necessary circuit elements, which may include a rechargeable power supply battery and battery charging circuitry such as a transformer, rectifier, transfer circuitry, test switch, and indicator lamp. The housing wall defines an opening through which partially extends a substantially spherical lighting head. The lighting head houses a light source such as, for example, a halogen lamp. The lighting head is rotatable within its opening to vary the direction of illumination provided by the light source.

Preferably, the rotation of the lighting head is restrained, as by friction, so as to fix the direction of illumination while allowing manual rotation to adjust the direction of illumination. Furthermore, a plurality of lighting heads may be employed -- both to increase and disperse the illumination and for redundancy.

BEST MODE FOR CARRYING OUT THE INVENTION

Figure 8:
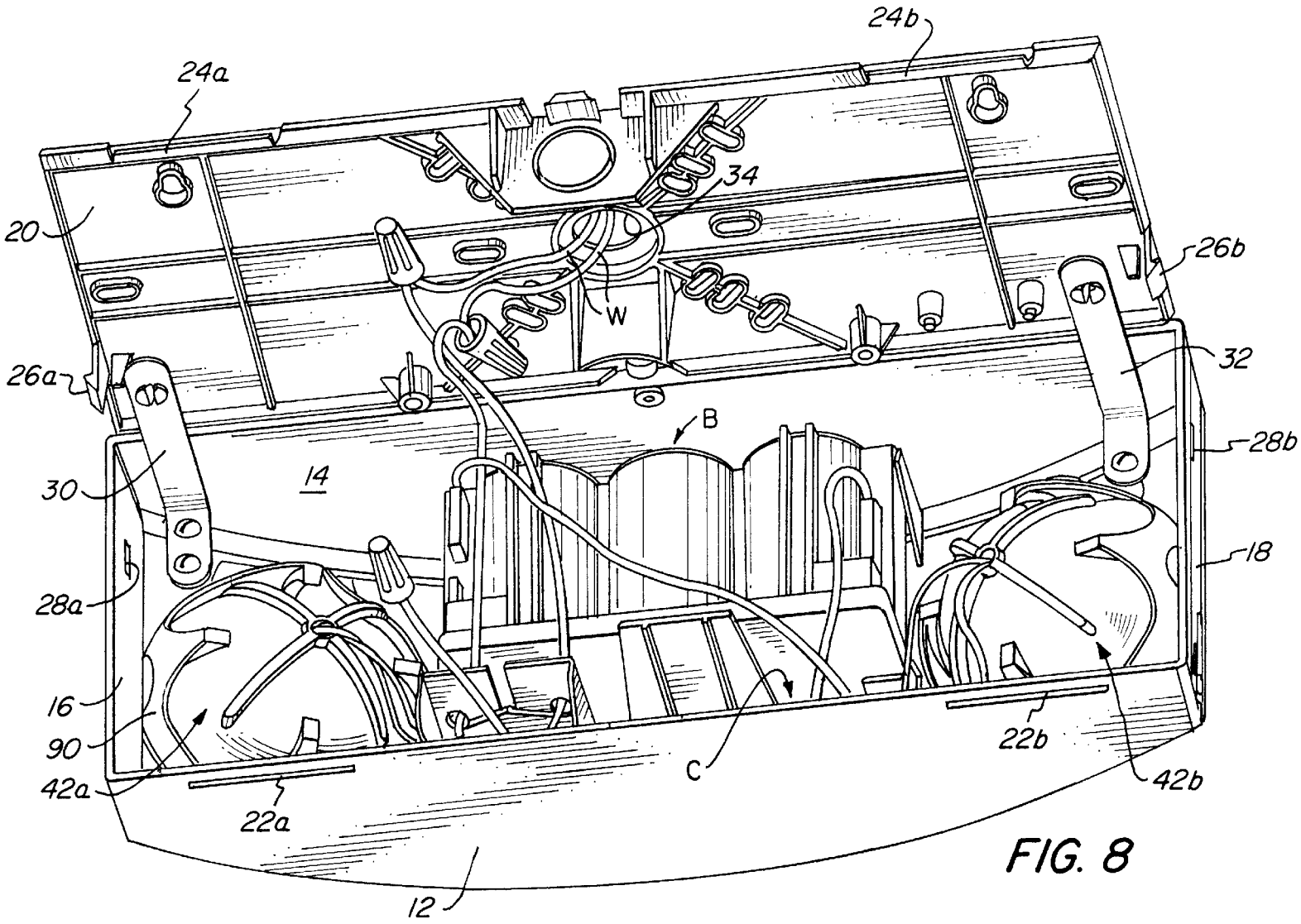
FIG. 8 is a rear perspective view of the lighting unit of the invention with the housing detached from the back plate to reveal its interior construction.

With particular reference to FIGS. 1–7, there is illustrated an emergency lighting unit in accordance with the present invention. It comprises an integral housing having a convexly curved front wall 10, top wall 12, bottom wall 14, a left sidewall 16, and a right sidewall 18. The housing is closed by a backplate 20 which is designed to be mounted against a flat surface such as a wall or ceiling. FIG. 8 illustrates the housing separated from the backplate 20. When the backplate 20 is mounted to a vertical surface such as a wall, a pair of slots 22*a*,22*b* (FIG. 8) in top wall 12 receive mating flanges 24*a*, 24*b* which extend from the top edge (as mounted) of the backplate 20. A pair of resilient latch members 26*a*, 26*b* snap into engagement with latch openings 28*a* in the left sidewall 16 and 28*b* in the right sidewall 18 when the housing is closed. A pair of flexible straps 30, 32 prevent the housing from separating completely from the backplate 20 during installation or maintenance. The backplate 20 includes a centrally located opening 34 for external power supply wiring W which supplies a rechargeable battery B, and other circuit elements generally designated as C in FIG. 8.

In an emergency lighting unit, the circuit elements C will customarily include an emergency power supply transformer, rectifier circuitry, transfer circuitry, battery charging circuitry, a switch, and an indicator lamp. The electronic components and circuitry are designed and mounted to a printed circuit board in a manner well known to those skilled in the art to charge the rechargeable battery B, as well as to switch to the emergency direct power supply provided by the rechargeable battery B if the alternating current power supply fails, as would be the case during a utility power outage. A test switch is used to test the operability of the emergency power supply.

Figure 1:
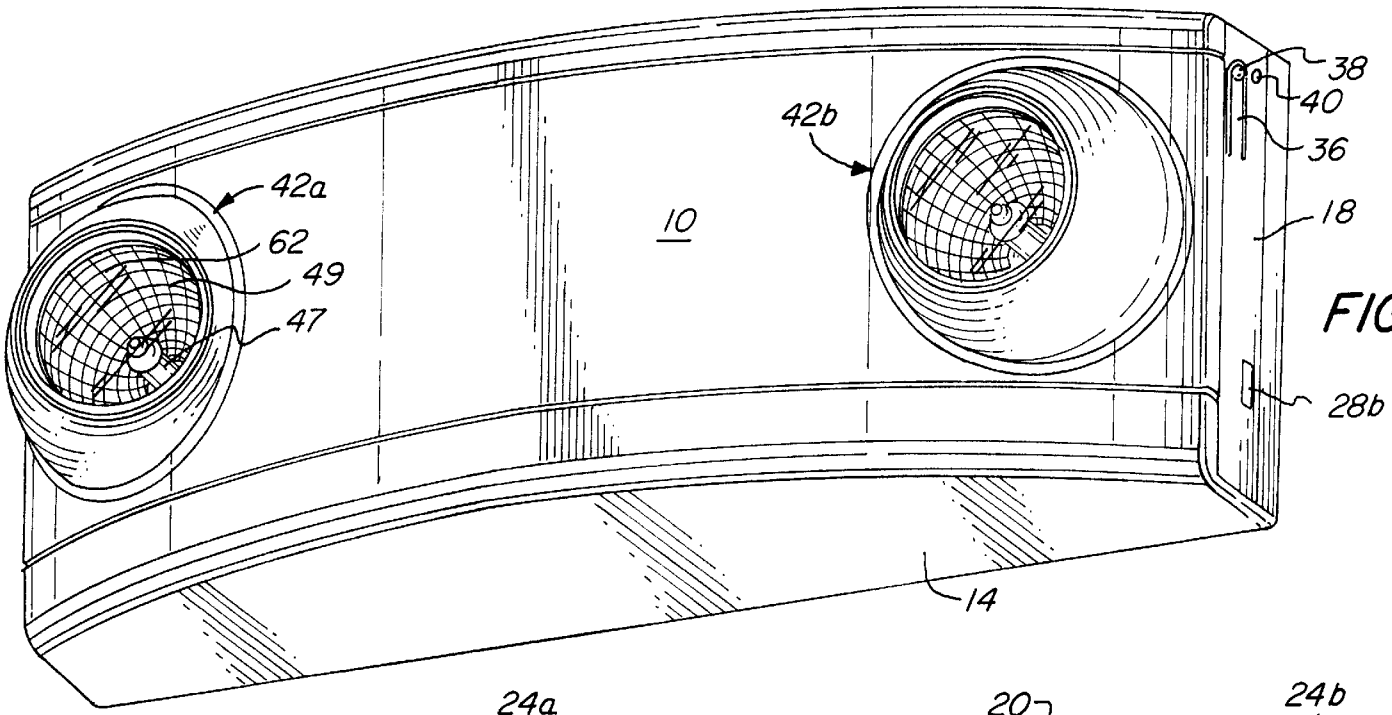
FIG. 1 is a perspective view of a lighting unit in accordance with the present invention.
Figure 2:
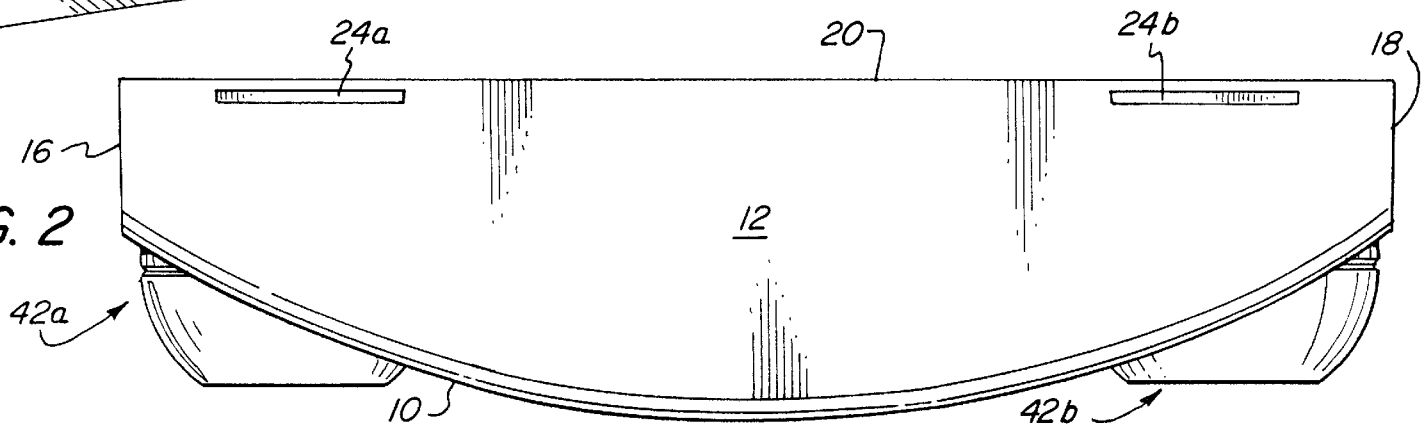
FIG. 2 is a plan view of the lighting unit of FIG. 1.
Figure 5:
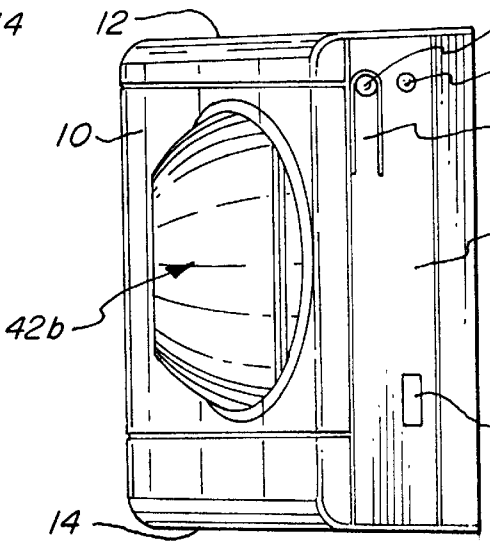
FIG. 5 is a right end view of the lighting unit of FIG. 1.
Figure 4:
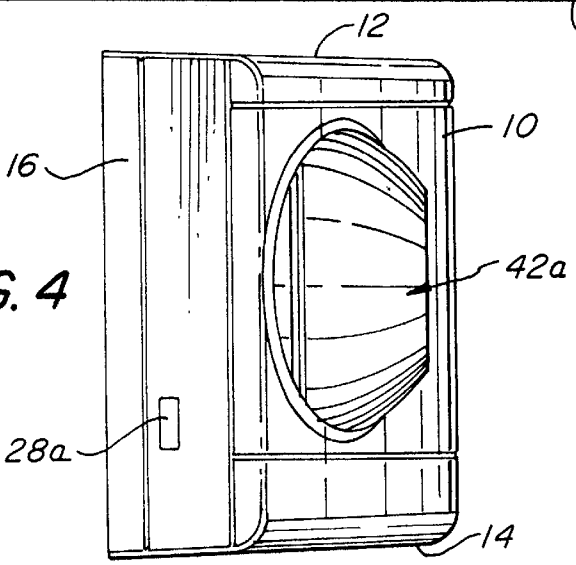
FIG. 4 is a left end view of the lighting unit of FIG. 1.
Figure 6:
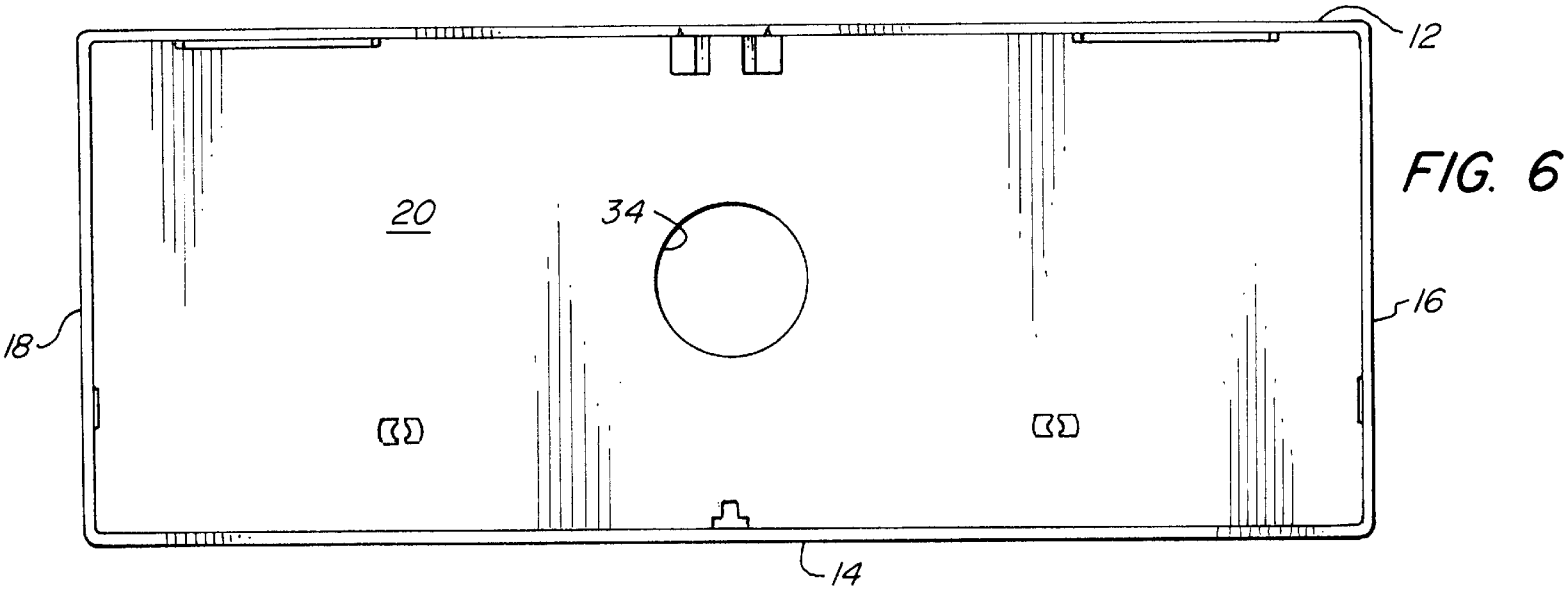
FIG. 6 is a rear elevational view of the lighting unit of FIG. 1.
Figure 7:
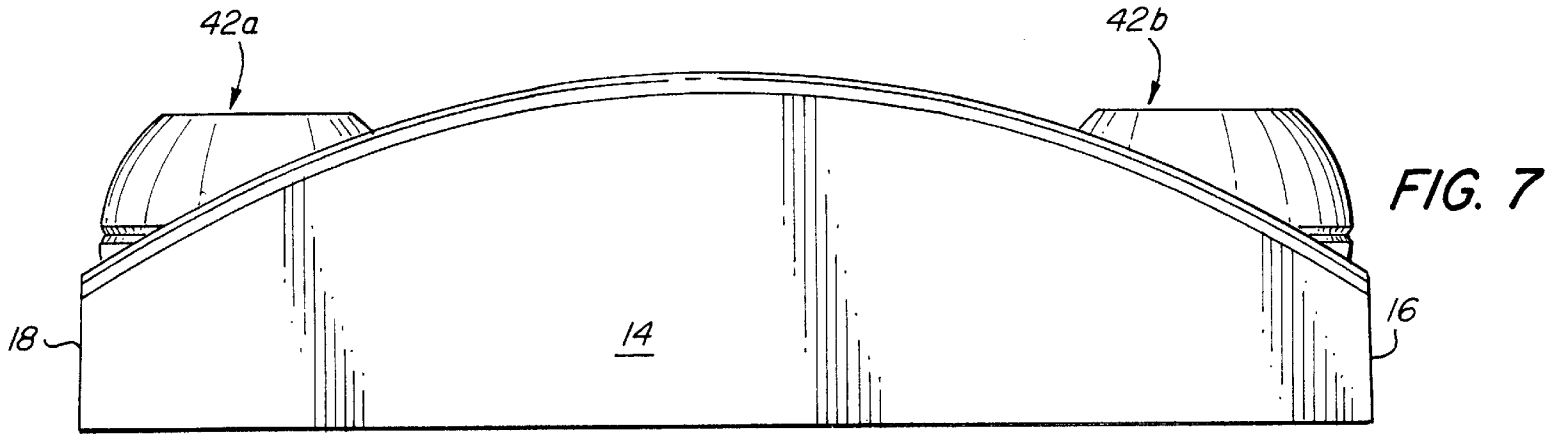
FIG. 7 is a bottom view of the lighting unit of FIG. 1.

As seen most clearly in FIGS. 1 and 5, the right sidewall 18 defines an elongated, U-shaped opening which forms a flexible tab 36 which carries a raised button 38. This forms a manual actuator for the test switch (not shown) which forms a part of the internal circuitry C. A small adjacent opening provides a window 40 for viewing the indicator lamp portion of the internal circuitry C.

Figures 12, 13:
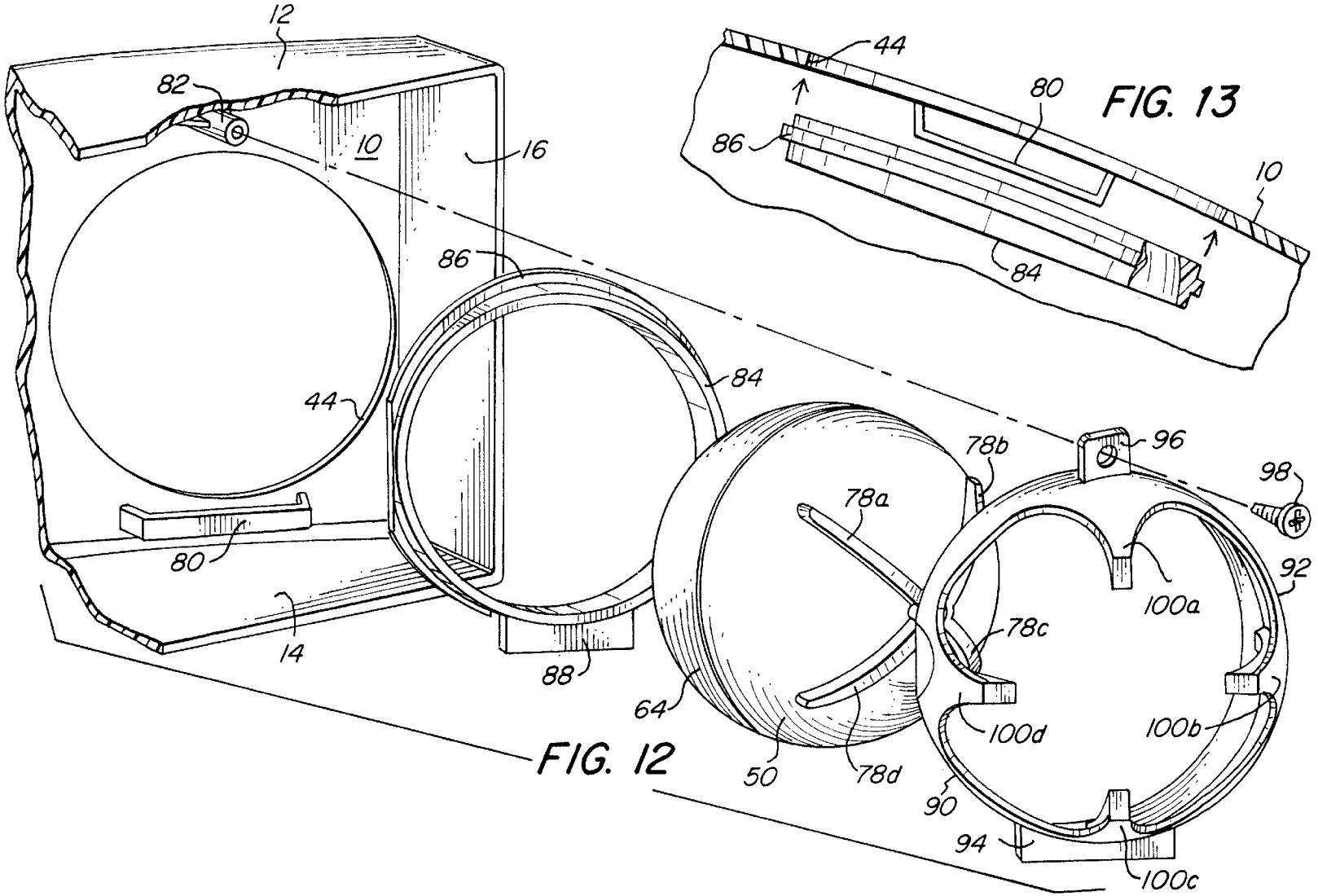
FIG. 12 is an exploded perspective view illustrating the manner of assembly of the lighting head of FIG. 9 to the lighting unit housing.
FIG. 13 is a cross-sectional view illustrating the assembly of a mounting ring employed to mount the lighting head of the invention to the housing of the lighting unit.
Figure 14:
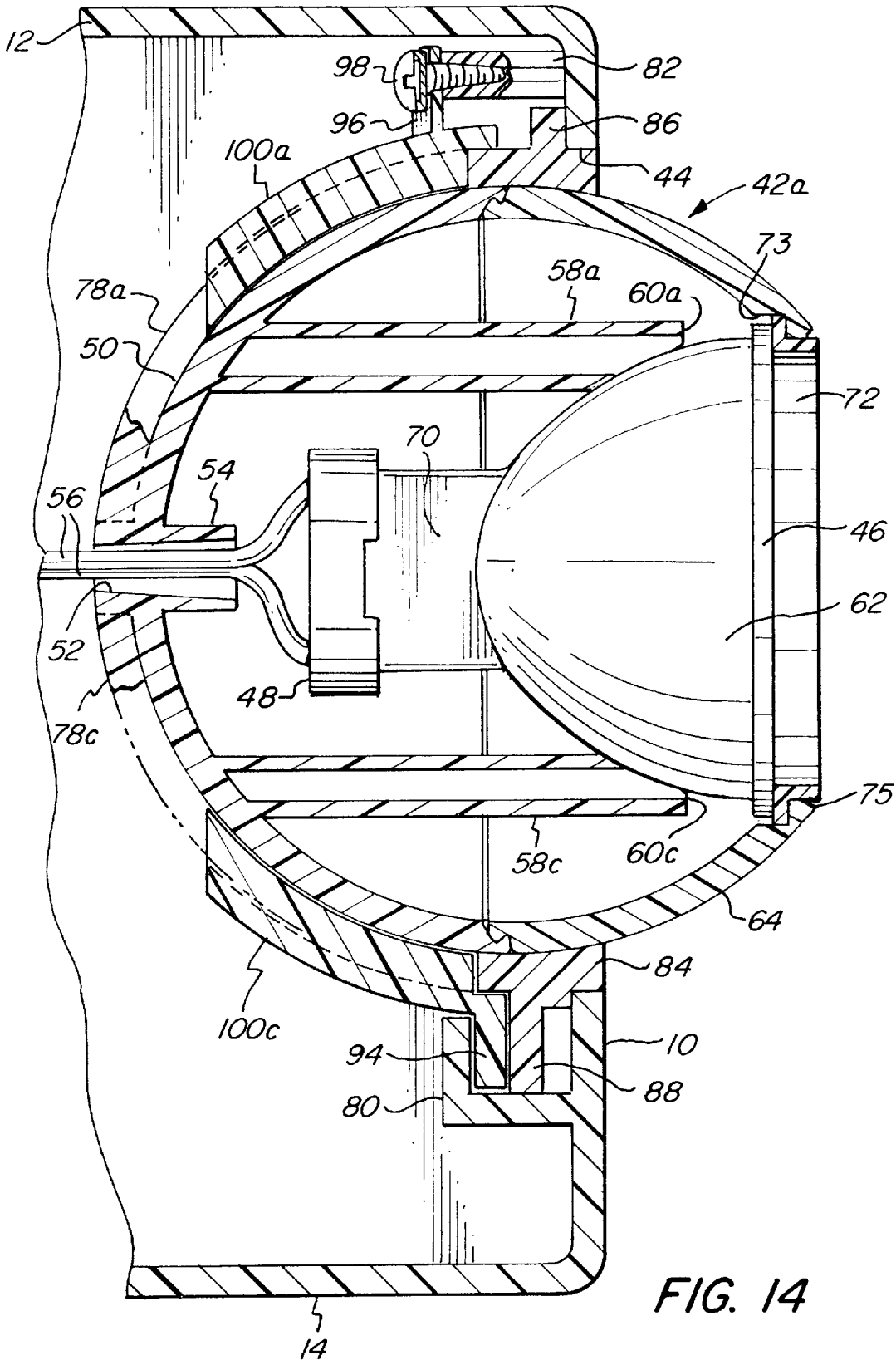
FIG. 14 is a cross-sectional view illustrating a portion of the housing and the lighting head mounted thereto.

A unique feature of the lighting unit of this invention comprises a pair of substantially spherical lighting heads 42*a,* 42*b* which partially extend through symmetrically positioned circular openings 44 (only one of which is shown in FIGS. 12–14). These openings 44 are positioned adjacent opposite ends of the curved front wall 10. The lighting heads 42*a,* 42*b* are identical, although they are mounted in reversed relationship within the housing due to the curvature of the front wall 10. Accordingly, only the left lighting head 42a will be described.

Figure 3:
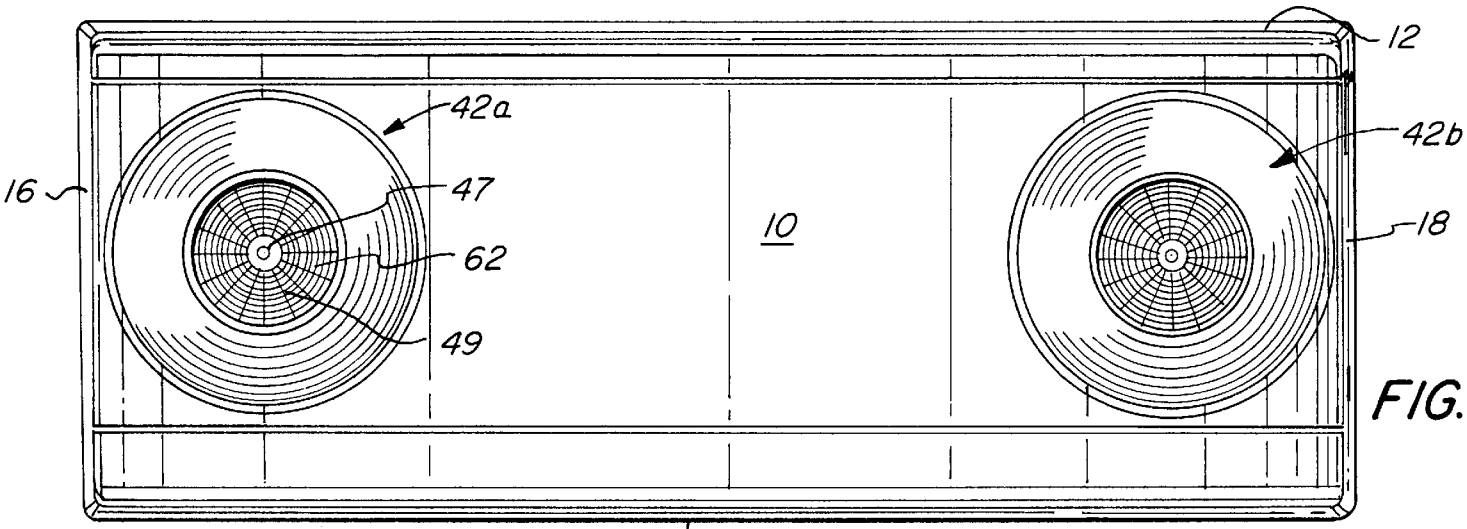
FIG. 3 is a front elevational view of the lighting unit of FIG. 1.
Figures 9, 10, 11:
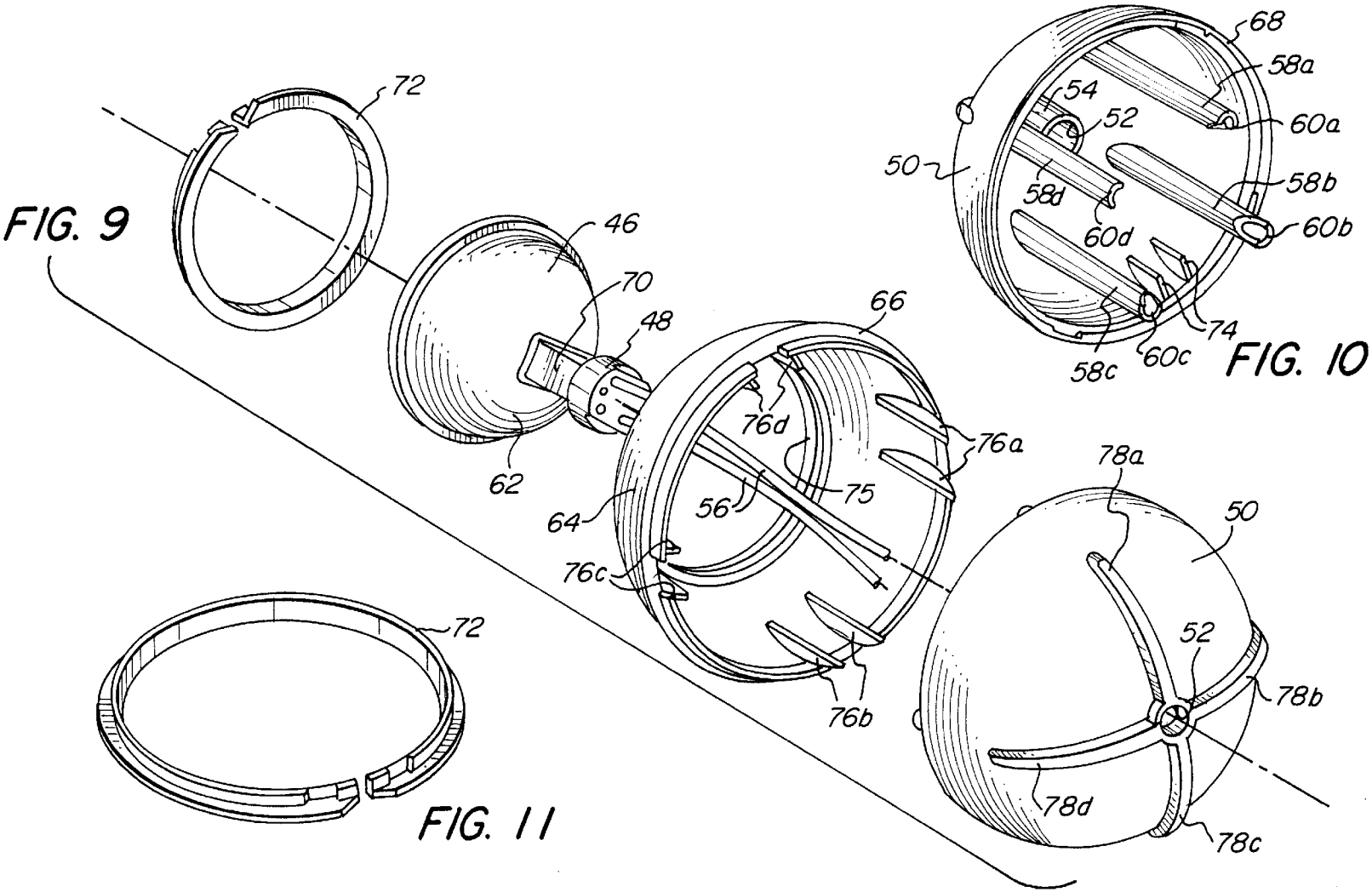
FIG. 9 is an exploded perspective view illustrating the assembly of a lighting head portion of the invention.
FIG. 10 is a perspective view, illustrating in more detail an element of the lighting head of FIG. 9.
FIG. 11 is a perspective view of another element of the lighting head of FIG. 9.

The lighting head 42*a* is designed to enclose a light such as, for example, a halogen lamp 46 and its power supply lamp socket 48, as illustrated in FIGS. 9 and 14. The lamp 46 can be a commercially available halogen MR-16 lamp, rated at 6 volts, 5 watts. As seen in FIGS. 1 and 3, lamp 46 has a halogen bulb 47 centrally located in a parabolic reflector 62 which is covered by a transparent lens 49. The lamp 46 is supported in a hemispherical shell 50 which defines a central conduit 52 in a boss 54, through which pass the electrical wire conductors 56 for supplying power to the lamp socket 48. Integral within the hemispherical shell 50, and extending outwardly therefrom, are four parallel tubular posts 58*a,* 58*b,* 58*c,* 58*d.* The outer ends 60a, 60b, 60c, 60d of these posts are chamfered so as to engage and support the generally paraboloidal surface of the reflector 62 of lamp 46, as is shown most clearly in FIG. 14. The lamp 46 is held in place against the post ends 60*a,* 60*b,* 60*c,* 60*d* by a semi-spherical containment shell 64 which snaps onto the hemispherical shell 50 by means of matching flanges 66, 68 as shown in FIGS. 9 and 10. The base 70 of the lamp 46 carries two prongs (not shown) which plug into the socket 48 to provide an electrical connection to the lamp 46. The lamp 46 is retained in this position by means of a resilient split ring 72 having an L-shaped cross-section, as is most clearly illustrated in FIGS. 9, 11, and 14. The split ring 72 fits in a circular recess 73 (FIG. 14) surrounding a central opening 75 in the containment shell 64.

The inside wall of the hemispherical shell 50 carries a pair of internally extending stops 74 (FIG. 10) which are complementary to matching stops 76*a,* 76*b,* 76*c,* 76*d* (FIG. 9) in containment shell 64. When the shells 50, 64 are joined, the stops 76*a,* 76*b,* 76*c,* 76*d* extend into the hemispherical shell 50. The interference between the stops thereby limits the relative rotation of the two shells 50, 64 and prevents unwanted twisting of the wire conductors 56.

As seen in FIG. 9, the exterior of the hemispherical shell 50 carries four raised ribs 78*a,* 78*b,* 78*c,* 78*d.* These ribs 78*a,* 78*b,* 78*c,* 78*d* are spaced at 90° intervals around the opening or conduit 52. They serve to limit rotation of the lighting head 42*a* relative to the housing front wall 10, as will be described below.

As will be clear from FIGS. 12–14, a bracket 80, which is integrally formed with the front wall 10, is positioned below the opening 44 on the inside of the housing. Above the opening 44 is a tapped boss 82. A mounting ring 84 fits within the opening 44 as shown in FIG. 14. The mounting ring 84 carries a raised circumferential rib 86 which bears against the inner surface of the front wall 10. A flat tongue 88 extends downwardly from the mounting ring 84 and into the bracket 80. The assembled lighting head 42*a* is then inserted into the mounting ring 84 in the position illustrated in FIG. 14. The entire assembly is completed by a semi-spherical mounting member 90, which is best illustrated in FIGS. 12 and 14. It comprises a ring portion 92, from which extends a bottom mounting tab 94 which seats in the bracket 80, and an upper screw tab 96 which seats against the tapped boss 82 and is held in place by means of a screw 98.

The mounting member 90 is characterized by four cantilevered radial fingers 100*a,* 100*b,* 100*c,* 100*d* which are positioned to lie between the ribs 78*a,* 78*b,* 78*c,* 78*d* on the lighting head 42*a.* They are also designed to bear resiliently against the surface of the hemispherical shell 50 of lighting head 42*a.* They serve two important functions. First, the radial fingers 100*a,* 100*b,* 100*c,* 100*d* limit the rotation of the lighting head 42*a* as they engage the ribs 78*a,* 78*b,* 78*c,* 78*d* on the rear of the lighting head 42*a,* thereby preventing undesirable twisting of the electrical conductors 56 attached to the socket 48 and limiting the aiming adjustment of the lighting head 42*a.* Their second important finction is to provide enough frictional engagement with the lighting head 42*a* that the latter will not be inadvertently moved. The fingers 100*a,* 100*b,* 100*c,* 100*d* are pressed against, and resiliently engage, the rear surface of the lighting head 42*a,* whereby exterior vibrations and the like encountered in normal building installations will not alter the aim of the lighting head 42*a,* once it is set by the user. To assist this feature, the engaging surfaces of the shell 50 or the fingers 100*a,* 100*b,* 100*c,* 100*d,* or both, may be roughened, or otherwise textured, to increase the amount of frictional engagement therebetween.

As previously stated, the lighting head 42*b* at the right end of front wall 10 and its mounting member are identical but reversed. Accordingly, the positions of the corresponding bracket and boss are reversed at that end, the bracket being at the top and the boss being at the bottom.

It will now be seen that there has been provided an emergency lighting unit in the form of a housing having a curved front wall, within which is mounted a pair of substantially spherical lighting heads which are independently adjustable. Not only are they independently adjustable but, due to the nature of their spherical mounting, they are capable of a wide range of movement which is easily achieved by hand manipulation. The curvature of the front wall 10 provides an initial angular displacement, broadening the illumination field. Furthermore, the unit has a trim appearance without unsightly protrusions, brackets, etc. The lamp 46 of either lighting head 42*a,* 42*b* is easily replaced by removing its split ring 72, withdrawing the lamp 46 and its socket 48, unplugging the lamp from the socket and replacing it with a new lamp. It is then returned to its position resting against the posts 58*a,* 58*b,* 58*c,* 58*d* and the split ring 72 is replaced.

The housing and backplate may be constructed of flame-rated, ultraviolet stable, ABS thermoplastic such as, for example, General Electric CYCOLAC®. If halogen lamps are employed, the plastic for any parts in contact with the lamps, e.g., the lamp housings, should be resistant to their high heat and are preferably constructed of a flame-rated ultraviolet stable polycarbonate thermoplastic such as General Electric LEXAN® 80676.

Figure 15:
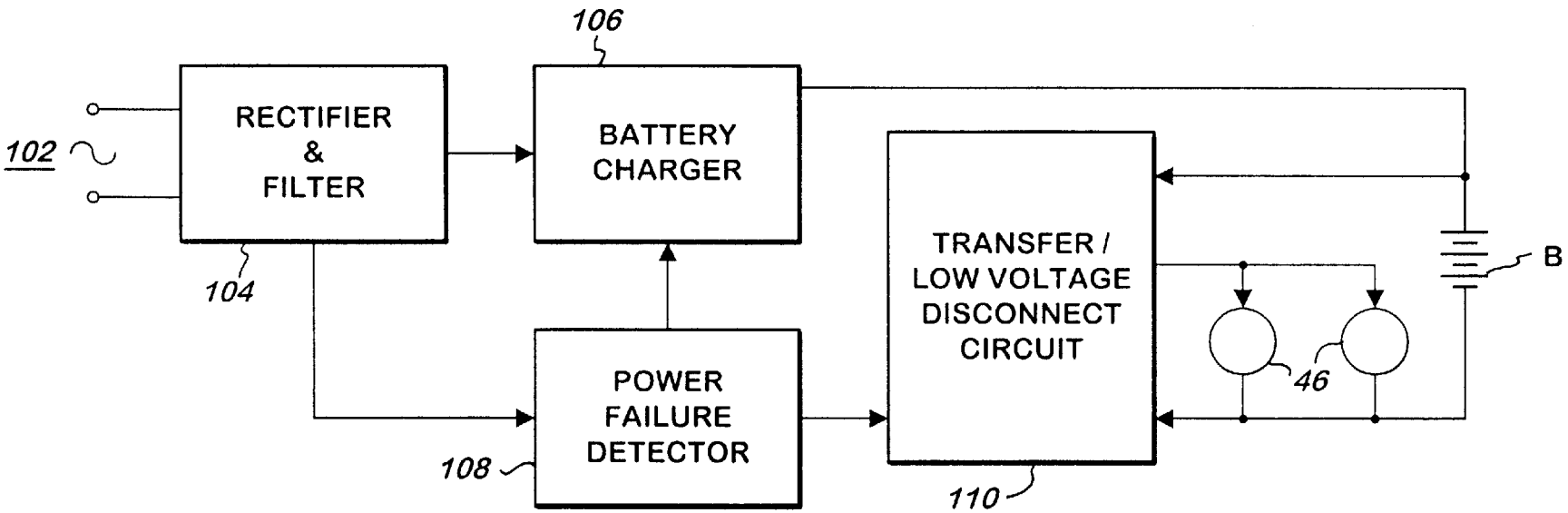
FIG. 15 is a block diagram of an emergency lighting circuit usable in the invention.

The block diagram of FIG. 15 illustrates one form of circuit usable in an emergency light in accordance with this invention. A building's alternating current power supply 102 is supplied to a rectifier and filter 104 which, in turn, supplies rectified and filtered current to a battery charger 106 and a power failure detector 108. A transfer/low voltage disconnect circuit 110 responsive to the power failure detector 108 activates the lamps 46 with power supplied by the battery B.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

What is claimed is:

1. An emergency lighting unit for providing emergency illumination during interruptions in utility power, the emergency lighting unit comprising:

a housing, said housing defining an opening therethrough;

a substantially spherical lighting head within said housing and extending partially through said opening;

a light source mounted within said spherical lighting head and adapted to illuminate a region exterior of said housing, said light source being a halogen lamp;

a socket for retaining said spherical lighting head within said opening to provide said spherical lighting head with a direction of illumination while permitting generally spherical movement of said spherical lighting head to vary the direction of illumination thereof, said socket enclosing a portion of said spherical lighting head and having an internal shape corresponding to an external shape of said spherical lighting head; and emergency electrical circuit elements electrically connected to said light source for providing emergency illumination during interruptions in utility power.

2. The emergency lighting unit of claim 1 wherein said socket comprises means for making frictional engagement with said spherical lighting head sufficient to fix the direction of illumination while permitting manual generally spherical movement of said spherical lighting head to vary the direction of illumination thereof.

3. The emergency lighting unit of claim 1, wherein said retaining means includes means to limit generally spherical movement of said spherical lighting head.

4. The emergency lighting unit of claim 1, wherein said spherical lighting head comprises:

a first hollow semi-spherical member;

a second hollow semi-spherical member; and means for interconnecting said first and second hollow semi-spherical members to form said spherical lighting head.

5. The emergency lighting unit of claim 4, wherein said first and second hollow semi-spherical members include means for limiting the relative rotation between said first and second hollow semi-spherical members.

6. The emergency lighting unit of claim 4, wherein said first hollow semi-spherical member includes internal means extending into said second hollow semi-spherical member for supporting said light source therein.

7. The emergency lighting unit of claim 1, wherein said spherical lighting head includes means for supporting said light source therein.

8. The emergency lighting unit of claim 7, wherein said supporting means includes a split ring which retains said light source within said spherical lighting head.

9. The emergency lighting unit of claim 1, wherein said light source has electrical conductors extending therefrom and said spherical lighting head is provided with a conduit through which said electrical conductors pass from said spherical lighting head into said housing.

10. The emergency lighting unit of claim 1, wherein said housing includes a substantially rectangular and convexly curved wall between a first end and an opposite second end, said substantially rectangular and convexly curved wall defines said opening.

11. The emergency lighting unit of claim 1, further comprising:

a substantially spherical second lighting head within said housing and extending partially through a second opening in said housing;

a second light source mounted within said second spherical lighting head and adapted to illuminate a region exterior of said housing; and means for retaining said second spherical lighting head within said second opening to provide said second spherical lighting head with a direction of illumination while permitting generally spherical movement of said second spherical lighting head to vary the direction of illumination thereof.

12. The emergency lighting unit of claim 11, wherein said second light source is electrically connected to said emergency electrical circuit elements for providing emergency illumination during interruptions in utility power.

13. The emergency lighting unit of claim 12, wherein said emergency electrical circuit elements comprise:

a rechargeable power supply operationally connected to utility power; and means for connecting said first and second light sources to said rechargeable power supply when utility power is interrupted.

14. The emergency lighting unit of claim 11, wherein said housing includes a substantially rectangular and convexly curved wall between a first end and an opposite second end, said substantially rectangular and convexly curved wall defining said opening for said spherical lighting head and said second opening for said second spherical lighting head.

15. The emergency lighting unit of claim 14, wherein said substantially rectangular and convexly curved wall defines a substantially rectangular and convexly curved exterior portion of said housing.

16. The emergency lighting unit of claim 11, wherein said second light source is a halogen lamp.

17. The emergency lighting unit of claim 16, wherein said second halogen lamp has a generally parabolic reflector and a halogen bulb centrally located therein.

18. The emergency lighting unit of claim 17, wherein said second halogen lamp has a transparent lens sealing said reflector of said second halogen lamp.

19. The emergency lighting unit of claim 1, wherein said lighting unit adjacent said light source is a heat-resistant plastic.

20. The emergency lighting unit of claim 19, wherein said plastic is a flame-rated, ultraviolet stable, polycarbonate thermoplastic.

21. The emergency lighting unit of claim 1, wherein said emergency circuit elements comprise:

a rechargeable power supply operationally connected to utility power, and means for connecting said light source to said rechargeable power supply when utility power is interrupted.

22. The emergency lighting unit of claim 1, wherein said emergency power supply includes a battery and a charging circuit therefor.

23. The emergency lighting unit of claim 1, wherein said halogen lamp has a generally parabolic reflector and a halogen bulb centrally located therein.

24. The emergency lighting unit of claim 23, wherein said halogen lamp has a transparent lens sealing said reflector.

25. An emergency lighting unit for providing emergency illumination during interruptions in utility power the emergency lighting unit comprising:

a housing, said housing defining an opening therethrough; a substantially spherical lighting head within said housing and extending partially through said opening;

a light source mounted within said spherical lighting head and adapted to illuminate a region exterior of said housing;

means for retaining said spherical lighting head within said opening to provide said spherical lighting head with a direction of illumination while permitting rotation of said spherical lighting head to vary the direction of illumination thereof, said retaining means comprises a socket within said housing enclosing a portion of said spherical lighting head, said socket comprises means for making frictional engagement with said spherical lighting head sufficient to fix the direction of illumination while permitting manual rotation of said spherical lighting head to vary the direction of illumination thereof, said frictional engagement means comprises fingers bearing against an outer surface of said spherical lighting head; and emergency electrical circuit elements electrically connected to said light source for providing emergency illumination during interruptions in utility power emergency lighting unit.

26. The emergency lighting unit of claim 25, wherein said outer surface of said spherical head is textured to provide frictional engagement with said fingers.

27. The emergency lighting unit of claim 26, wherein said fingers are cantilevered from said socket.

28. The emergency lighting unit of claim 25, wherein said housing includes a substantially rectangular and convexly curved wall between a first end and an opposite second end, said substantially rectangular and convexly curved wall defines said opening.

29. The emergency lighting unit of claim 28, wherein said substantially rectangular and convexly curved wall defines a substantially rectangular and convexly curved exterior portion of said housing.

30. An emergency lighting unit for providing emergency illumination during interruptions in utility power the emergency lighting unit comprising:

a housing, said housing defining an opening therethrough;

a substantially spherical lighting head within said housing and extending partially through said opening;

a light source mounted within said spherical lighting head and adapted to illuminate a region exterior of said housing;

means for retaining said spherical lighting head within said opening to provide said spherical lighting head with a direction of illumination while permitting rotation of said spherical lighting head to vary the direction of illumination thereof, said retaining means includes means to limit rotation of said spherical lighting head said rotation limiting means comprise a plurality of fingers adapted to bear against an outer surface of said spherical lighting head: and emergency electrical circuit elements electrically connected to said light source for providing emergency illumination during interruptions in utility power.

31. The emergency lighting unit of claim 30, wherein said outer surface of said spherical lighting head has upstanding ribs against which said fingers bear to limit rotation of said spherical lighting head and varying of the direction of illumination of said spherical lighting head.

32. The emergency lighting unit of claim 30, wherein said housing includes a substantially rectangular and convexly curved wall between a first end and an opposite second end, said substantially rectangular and convexly curved wall defines said opening.

33. The emergency lighting unit of claim 32, wherein said substantially rectangular and convexly curved wall defines a substantially rectangular and convexly curved exterior portion of said housing.

34. An emergency lighting unit for providing emergency illumination during interruptions in utility power, the emergency lighting unit comprising:

a housing, said housing defining an opening therethrough:

a substantially spherical lighting head within said housing and extending partially through said opening, said spherical lighting head includes means for supporting a light source therein said supporting means includes a plurality of posts adapted to seat a light source a lighting source seated upon said plurality of posts within said spherical lighting head and adapted to illuminate a region exterior of said housing means for retaining said spherical lighting head within said opening to provide said spherical lighting head with a direction of illumination while permitting rotation of said spherical lighting head to vary the direction of illumination thereof; and emergency electrical circuit elements electrically connected to said light source for providing emergency illumination during interruptions in utility power.

35. The emergency lighting unit of claim 34, wherein said housing includes a substantially rectangular and convexly curved wall between a first end and an opposite second end, said substantially rectangular and convexly curved wall defines said opening.

36. The emergency lighting unit of claim 35, wherein said substantially rectangular and convexly curved wall defines a substantially rectangular and convexly curved exterior portion of said housing.

37. An emergency lighting unit for providing emergency illumination during interruptions in utility power, the emergency lighting unit comprising:

a housing, said housing defining a housing opening therethrough;

a substantially spherical lighting head within said housing and extending partially through said housing opening, said spherical lighting head includes means for supporting a light source relative to a central opening of said spherical lighting head, said supporting means includes a split ring fit within said spherical lighting head at said central opening;

a lighting source retained relative to said central opening by said split ring of said supporting means within said spherical lighting head and adapted to illuminate a region exterior of said housing;

means for retaining said spherical lighting head within said housing opening to provide said spherical lighting head with a direction of illumination while permitting rotation of said spherical lighting head to vary the direction of illumination thereof; and emergency electrical circuit elements electrically connected to said light source for providing emergency illumination during interruptions in utility power.

38. The emergency lighting unit of claim 37, wherein said split ring is seated in a recess in said spherical lighting head at said central opening.

* * * * *

UNITED STATES PATENT AND TRADEMARK OFFICE

CERTIFICATE OF CORRECTION

PATENT NO. : 6,019,477

DATED : February 1, 2000

INVENTOR(S) : Joseph Wegrzyn, Jeff Holmes and Milt Erickson

It is certified that error appears in the above-identified patent and that said Letters Patent is hereby corrected as shown below:

In column 3, line 64, "fiat" should be --flat--.

In column 4, line 18, "finction" should be --function--.

In column 6, line 66 (claim 25, line 2), after "power", --,-- should be inserted.

In column 7, line 39 (claim 30, line 2), after "power", --,-- should be inserted.

In column 7, line 53 (claim 30, line 15), after "head", --,-- should be inserted.

In column 7, line 56 (claim 30, line 18), ":" should be --;--.

UNITED STATES PATENT AND TRADEMARK OFFICE

CERTIFICATE OF CORRECTION

PATENT NO. : 6,019,477

DATED : February 1, 2000

INVENTOR(S) : Joseph Wegrzyn, Jeff Holmes and Milt Erickson

It is certified that error appears in the above-identified patent and that said Letters Patent is hereby corrected as shown below:

In column 8, line 11 (claim 34, line 4), ":" should be --;--.

In column 8, line 15 (claim 34, line 8), after "therein", --,-- should be inserted.

In column 8, line 16 (claim 34, line 9), after "source", --;-- should be inserted.

In column 8, line 19 (claim 34, line 12), after "housing", --;-- should be inserted.

Signed and Sealed this

Sixteenth Day of January, 2001

*Attest:*

*Attesting Officer*

Q. TODD DICKINSON

*Commissioner of Patents and Trademarks*